US005431282A

United States Patent [19]

Kremp et al.

[11] Patent Number: 5,431,282

[45] Date of Patent: Jul. 11, 1995

[54] END WALL MADE OF INJECTION MOLDED MATERIAL FOR A WOUND FILM

[75] Inventors: Heinz Kremp, Illingen; Norbert Born, Blieskastel, both of Germany

[73] Assignee: Hoechst Aktiengesellschaft, Frankfurt am Main, Germany

[21] Appl. No.: 159,573

[22] Filed: Dec. 1, 1993

[30] Foreign Application Priority Data

Dec. 7, 1992 [DE] Germany ..... 42 41 115.7

[51] Int. Cl.[6] ..... B65D 85/672

[52] U.S. Cl. ..... 206/413; 206/416; 206/397

[58] Field of Search ..... 206/405, 406, 408, 413, 206/416, 391, 397; 220/671

[56] References Cited

U.S. PATENT DOCUMENTS

| | | | |
|---|---|---|---|
| 2,849,151 | 8/1958 | Heil | 220/97 |
| 3,120,322 | 2/1964 | Henninger | 220/671 |
| 3,260,362 | 7/1966 | Schwinne | 206/408 |
| 3,352,410 | 11/1967 | Salladay | 206/408 |
| 3,402,871 | 9/1968 | Palmer | 220/671 |
| 3,737,028 | 6/1973 | Carlson | 206/416 |
| 4,125,187 | 11/1978 | Vecchiotti | 220/671 |
| 4,826,008 | 5/1989 | Cloosterman | 206/413 |
| 4,884,690 | 12/1989 | Klenter et al. | 206/416 |
| 5,097,951 | 3/1992 | Pigott et al. | 206/413 |
| 5,105,943 | 4/1992 | Lesko et al. | 206/416 |
| 5,205,411 | 4/1993 | Born et al. | 206/391 |

FOREIGN PATENT DOCUMENTS

| | | |
|---|---|---|
| 1991976 | 5/1965 | Germany . |
| 1937964 | 5/1967 | Germany . |
| 1486562 | 3/1969 | Germany . |
| 2027808 | 12/1971 | Germany . |
| 3808064 | 3/1989 | Germany . |
| 1497929 | 1/1978 | South Africa . |

*Primary Examiner*—David T. Fidei
*Attorney, Agent, or Firm*—Foley & Lardner

[57] ABSTRACT

An end wall 1 is composed of a plate 11 which forms, on the front side, a flat surface with an annular attachment 35, whereas the reverse side is reinforced by radial ribs 5 and annular ribs 14. The radial ribs 5 are stiffened by webs 32 which run perpendicular to the plate 11. Further webs 33 reinforce rounded webs 17 of locking lugs 4. On the front side of the plate 11 is disposed a central plug-in peg 2 which is surrounded by the annular attachment. Three sides walls 13 of the plate 11 are provided with stacking lugs 9, 19 which delimit stacking pockets 8, 18 which are designed in a manner complementary to the stacking lugs. The fourth side wall 30 of the end wall has a corrugation 31 and, in the case of a wound roll packaged with the end walls, lies on a pallet. The annular attachment prevents contact between the edge region of the wound roll and the end wall thereby avoiding compressions in the edge region of the wound roll.

19 Claims, 4 Drawing Sheets

END WALL MADE OF INJECTION MOLDED MATERIAL FOR A WOUND FILM

BACKGROUND OF THE INVENTION

The present invention relates to an end wall made of injection molded material for a wound roll. The end wall has a rectangular, in particular square, plate that has rounded corner surfaces. The front side of the plate, facing toward the wound roll, has a central plug-in peg and locking lugs, and the reverse side of the plate, facing outward away from the wound roll, is stiffened by radial and annular ribs. The side walls of the plate have stacking lugs that delimit stacking pockets that are at right angles to the plate. The stacking pockets are shaped in a manner complementary to the stacking lugs.

An end wall of this kind is known from Patent DE-PS 38 08 064 and U.S. Pat. Nos. 4,884,690 and 5,205,411. U.S. Pat. No. 4,884,690 and 5,205,411 are hereby expressly incorporated by reference.

An individual one-part end wall of this kind that is made of plastic or of another material that can be formed without cutting is intended for packaging material wound onto winding tubes, for example plastic films. The one-part end wall forms, together with a second, corresponding end wall, a dimensionally stable overall package for a wound roll.

From the known end wall described above, a number of vertically aligned end walls of ready-packaged wound rolls can be stacked with their side walls one next to the other or one above the other, as desired, and can be locked into engagement with respect to one another. This means that wound rolls ready-packaged by means of the end walls and encircling straps can be readily stacked one on top of the other. The ready-packaged wound rolls are usually stacked on wooden pallets. Here, it is found that, because of the smooth surfaces of the support faces of the stacking lugs, the side wall that is lying on the pallet and that is a part of the end wall has a low frictional grip with the pallet, so that the slipping resistance of a stack of this kind is not ensured. If, in particular, heavy wound rolls are packaged with such end walls, then, because of the low frictional grip and also because of the small support faces of the stacking lugs on the pallet and the high specific surface pressure that this entails, along with the high surface loading on the stacking lugs, there is increased risk of breakage and inadequate stability of the supported side wall.

German Utility Model 19 91 976 discloses a one-part end wall which is made of plastic and is composed of a quadrangular, preferably square, flat plate stiffened by radial webs. In the center is disposed a plug-in peg for the roll of wound material, which plug-in peg is equipped, for example, with holding prisms. The plate is encased by a strap, on the outer side of which small prismatic strips are arranged. At the corners of the plate, the strap encloses four cup-shaped depressions, which project into the free space between the wound material and packaging sleeve and are open near the outer end side, and the strap possesses a surrounding stop strip which is provided with teeth.

DE-OS 14 86 562 discloses a protective package for film rolls and metal rolls, which is composed of two similar flanges equipped with a hollow hub that can be inserted into the winding core of the roll. Each of these flanges has at least two outer edges or edge parts which are bordered parallel to one another and are equipped with incisions and tongues, by means of which, during stacking of a plurality of rolls one on top of the other, interlocking of the flange edges lying one above the other is achieved and mutual displacement of the stacked rolls is prevented. These flanges cannot be stacked arbitrarily, but only in a specific arrangement next to each other or one above the other and brought into engagement with one another.

GB Patent 1,497,929 describes square end walls for wound rolls, flanges being present along each side edge of an end wall and at right angles to the end wall. One of the four surrounding flanges has two projecting pegs whereas the opposite flange has two holes at the locations corresponding to the locations of the pegs. The stacking of the wound rolls takes place in rows, the upper row of the wound rolls being offset with respect to the lower row in such a manner that the pegs of one end wall are in engagement with the holes of two adjacent end walls lying therebelow, thus preventing a lateral displacement of the two rows of wound rolls with respect to one another.

In the case of the known end walls, the end walls can be stacked, without a wound roll, one above the other with further, horizontally aligned end walls. The vertically aligned end walls, in particular with the wound rolls, can only be stacked in a specific arrangement next to one another or one above the other and brought into engagement with one another. This means that ready-packaged wound rolls cannot readily be stacked directly one above the other, simply and reliably.

In the case of flat front sides of the end walls, compressions can occur in the soft, that is, loosely wound, edge region with respect to the core region of the wound roll, due to the slightly oblique position of the end walls with respect to the end surfaces of the wound roll. It is possible for the oblique position to occur as early as during packaging of the wound rolls with the end walls, or by the packaged wound rolls slipping during transport, loading or unloading.

SUMMARY OF THE INVENTION

Objects of the present invention include to further develop the known end walls so that contact of the edge region of the wound roll with the end walls and contingent compressions of the edge region of the wound roll are avoided; a simple, reliable and slip-proof stacking of the wound rolls, packaged with the end walls, on pallets is provided; and the strength of the end walls is increased.

These and other objects of the invention are achieved by an end wall for a wound roll including a rectangular plate having rounded corner surfaces, a front side that faces toward the wound roll and having a central plug-in peg and locking lugs, a reverse side that faces outward away from the wound roll, and side walls; radial and annular ribs located on said plate for stiffening said plate; stacking lugs and stacking pockets located on at least one side wall of the plate at right angles to the plate, the stacking lugs delimiting and being shaped in a manner complementary to the stacking pockets; and an annular attachment located on the front side of the plate and surrounding the plug-in peg.

In a preferred embodiment of the invention, the annular attachment has an external diameter d which is smaller than the edge length a of the end wall and is smaller than the diameter D of the wound roll.

In another embodiment of the invention, the annular attachment is an integral component of a second attachment, the outer edges of which are set back with respect to the edges of the plate by the depth of guide grooves and have, at the corners, circular recesses having diameters larger than those of the locking lugs.

Preferably, the thickness S of the annular attachment is greater than the thickness s of the second attachment.

Other objects, features, and advantages of the present invention will become apparent from the following detailed description taken in conjunction with the Figures.

BRIEF DESCRIPTION OF THE DRAWINGS

The drawings are hereby expressly made a part of the specification. The invention is explained in greater detail below with reference to three diagrammatically illustrated exemplary embodiments, in which.

DETAILED DESCRIPTION OF THE PREFERRED EMBODIMENTS

The invention achieves the advantages that the annular attachment, alone or together with the second attachment, ensures that the wound roll, with its larger diameter with respect to the annular attachment, does not come into contact at its edge region, which is wound more loosely than its core region, with the end wall or walls, so that the wound material cannot be compressed, that the corrugation ensures a secure grip of the packaged wound roll on the pallet and, furthermore, distributes the loading of the side wall, supported on the pallet and belonging to the end wall, uniformly over the entire length of the side wall, so that, together with the reinforcement of the reverse side of the end wall by additional webs, the risk of breakage of the side wall is thereby largely eliminated, and the bevelled side surfaces of the stacking lugs and stacking pockets permit a problem-free stacking and destacking of the rolls packaged with these end walls.

Figure 1:
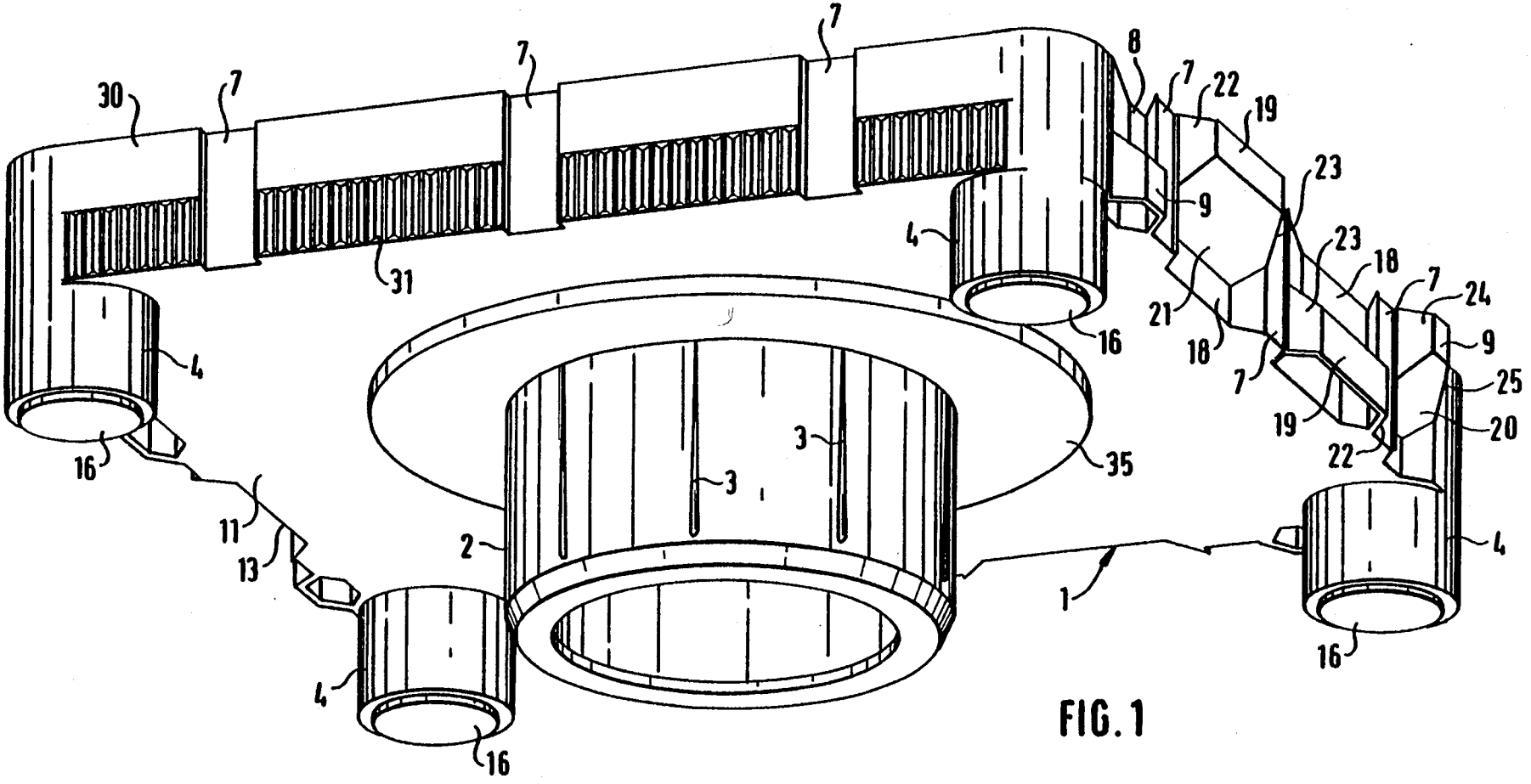
FIG. 1 shows a perspective bottom view of the front side of a first embodiment of an end wall according to the invention.

As FIG. 1 shows, the end wall 1 is composed of a rectangular, in particular square, plate 11, on the four corners of which locking lugs 4 are arranged which have lug protrusions 16. On three side walls 13 of the plate 11 of an end wall 1, stacking lugs 9, 19 are present and have different lengths and different cross-sections, while the fourth side wall 30 is equipped with a corrugation 31.

As can be seen from the perspective view of the front side of the end wall 1 in FIG. 1, corner surfaces 15 of the end wall 1 are rounded, and the cylindrical locking lugs 4 are integrated with these corner surfaces and have the same radius as the rounded corner surfaces 15. The cylindrical lug protrusions 16 are offset from the locking lugs 4 by a shoulder and have a smaller diameter than the locking lugs. The front side, facing toward the wound roll, protects the end side of the wound roll against damage, in particular during transport, and has an annular attachment 35 which surrounds a central plug-in peg 2. The annular attachment 35 has an external diameter d and, including the wall thickness s of the plate 11, a thickness S. The external diameter d is smaller than the edge length a of the end wall 1 and also smaller than the diameter D of a wound roll 27 (cf. FIG. 4). The wall thickness s is in the range from 2 to 4 mm, in particular it is 2.5 mm. The annular attachment 35 is, for example, formed from the same plastic as the end wall 1. The thickness S comprising the wall thickness s and the annular attachment is in the range from 4 to 20 mm.

On the outer surface of the plug-in peg 2, V-shaped webs 3 run parallel to the longitudinal axis of the plug-in peg and possess a cross-section becoming smaller toward the front side of the plate 11 The plug-in peg 2' is pushed or force-fit into the bore in the winding tube. The V-shaped webs 3 on the plug-in peg 2 ensure a better grip of the plug-in peg in the winding tube and compensate for the dimensional tolerances of the winding tube, on the one hand, and of the plug-in peg, on the other hand. The diameter of the hollow-cylindrical plug-in peg 2 is matched to the diameter of the respective bore of the winding tube.

Figure 2:
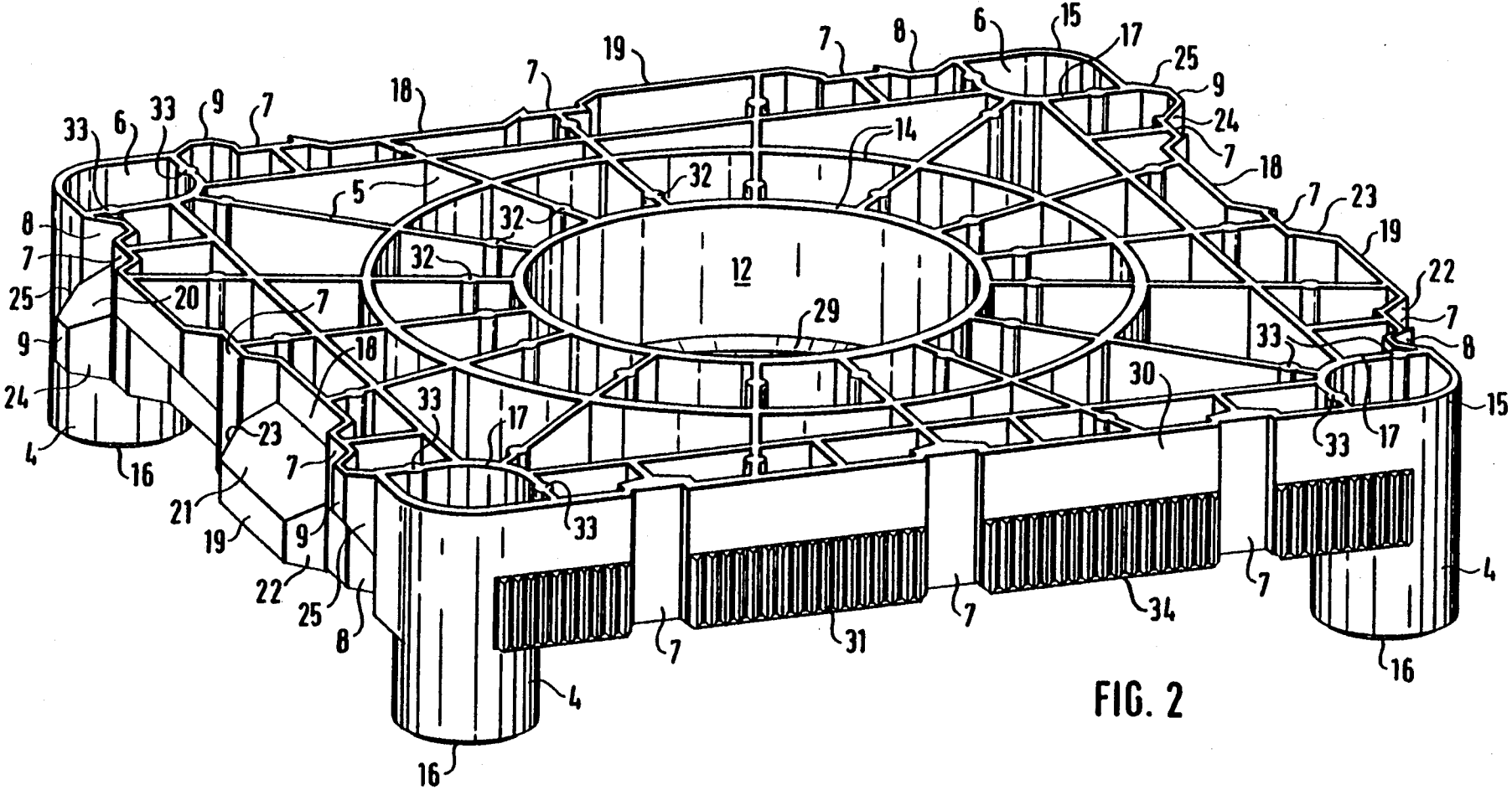
FIG. 2 shows a perspective view of the reverse side of the end wall according to FIG. 1.

The perspective view in FIG. 2 of the reverse side of the end wall 1, which is directed away from the wound roll and faces outward, shows radial ribs 5 and annular ribs 14 which stiffen the reverse side and thereby avoid excessive wall thicknesses, so that the individual weight of the end wall 1 can be kept small. The radial and annular ribs provide a high load-bearing capacity of the end wall 1 with low intrinsic weight. The radial ribs 5 are additionally reinforced and stiffened by webs 32 which run perpendicularly to the plate 11 in the surface of the radial ribs 5. As can be seen from FIGS. 1 and 2, the stacking lugs 9 and 19 delimit stacking pockets 8, 18 which are designed in a manner complementary to the stacking lugs. The stacking lugs 9 are shorter than the stacking lugs 19. The basic body of the two groups of stacking lugs 9, 19 is in each case square, one side surface 20 or 21 of the stacking lug 9 or 19, respectively, being bevelled and inclined toward the side wall 13. In each case one stacking lug 9 is arranged near one of the two corner surfaces 15 of one side wall 13, one stacking lug 9 being designed such that it is rotated through 180° with respect to the other stacking lug 9. The two other stacking lugs 19 of one side wall 13 are likewise rotated by 180° with respect to one another and offset diagonally with respect to one another. In each case one stacking lug 9 and 19 is aligned, for example, with the lower edge of the side wall 13, whereas the stacking lugs 19 and 9, rotated through 180° with respect thereto, are aligned with the top edge of the side wall 13.

The longer stacking lug 19 also has, in addition to the bevelled side surface 21, inclined surfaces 22, 23. The stacking lugs 19, 19 which are rotated through 180° with respect to one another and lie diagonally opposite one another are arranged such that the inclined surfaces 22, 23 lying diagonally opposite one another appear to overlap when viewed along a line perpendicular to these surfaces. The stacking lug 19 is tapered in the form of a truncated pyramid by the inclined surfaces 21, 22, 23. The group of shorter stacking lugs 9 likewise possesses, per stacking lug, inclined surfaces 24, 25. The inclined surfaces 22, 24; 23, 25, opposite one another at a distance, of the stacking lugs 9 and 19 form the respective delimiting walls for a guide groove 7 which receives an encircling strap of the wound roll 27.

Figure 3:
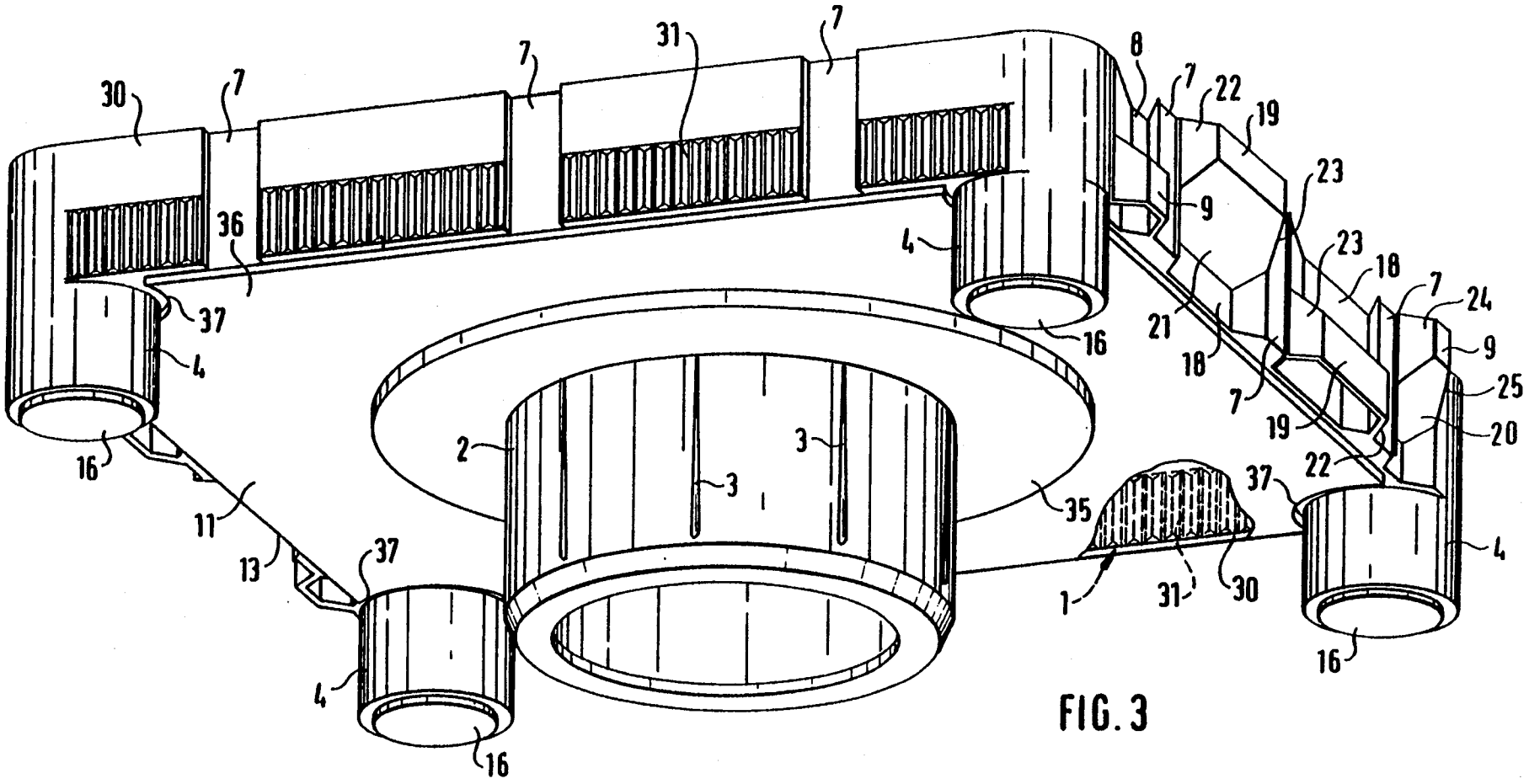
FIG. 3 shows a perspective bottom view of a second embodiment of an end wall according to the invention.

In the side walls 13 and 30 are located in each case at least two guide grooves 7 which are, for example, 20 mm wide and approximately 10 mm deep. Three guide grooves 7 are shown in FIGS. 2 and 3. The corrugation 31 between two guide grooves 7 is composed of prismatic corrugations 34 with triangular cross-sections.

The two end walls of a wound roll are firmly joined to the wound roll by encircling with two or three encircling straps made of plastic or metal. The exact distance of the guide grooves 7 from one another is chosen such that the encircling straps can be applied by means of a tandem strapping system. If necessary, the end wall edges may be reinforced at the encirclement points and the guide grooves may obtain the corresponding strength by means of an opposite end wall rib.

The radial ribs 5 and the annular ribs 14 of the reverse side of the plate 11 are located at the same level as the outer edge or the edge of the side walls 13 and 30 of the plate 11. In the exemplary embodiment described, in each case two stacking lugs 9 and two stacking lugs 19 are provided per side wall 13. This number of stacking lugs is sufficient, for example, for dimensions of 485×505 mm of the end wall 1, however, it is obvious that, in the case of larger dimensions of the end wall, such as, for example, 585×605 mm or 680×700 mm, correspondingly more stacking lugs 9 and 19 must be present per side wall. The number of guide grooves 7 is then also greater than three.

As can be seen from FIG. 2, the plate 11 has a central cylindrical passage-opening 12. The hollow-cylindrical plug-in peg 2 is connected to this central passage-opening 12 via a shoulder 29. The diameter of the passage-opening 12 is larger than the external diameter of the plug-in peg 2. On the reverse side of the plate 11 are located recesses 6 which are surrounded by the rounded corner surfaces 15 and the rounded webs 17. The recesses 6 adjoin the reverse side of the hollow-cylindrical locking lugs 4. The rounded webs 17 are reinforced by further webs 33 which run perpendicularly to the plate 11. The cylindrical webs 33 have a diameter which is larger than the wall thickness of the rounded webs 17.

If two horizontally aligned end walls 1 are stacked one above the other, then the lug protrusions 16 of the locking lugs 4 of an end wall engage in the recess 6 on the reverse side of the plate 11 of the end wall lying thereabove. The plug-in peg 2 likewise engages in the passage-opening 12, providing the possibility of stacking and palletizing the end walls in a space-saving manner.

The stacking lugs and stacking pockets engage in one another in such a manner that a displacement longitudinally or transversely to the side wall 13 is not possible. The bevelled side surfaces 20, 21 of the stacking lugs and of the stacking pockets permit a problem-free stacking and destacking of the wound rolls packaged with these end walls. A mutual locking of the complete wound rolls, which are stacked one above the other or one next to the other and are packed by the end walls 1, is achieved.

The end walls 1 are produced, for example, from thermoplastics by injection molding. Regenerated and recycled materials can be used for this. The stacking lugs, like the webs and ribs, are shaped in the same injection molding operation.

Since three side walls 13 of the end wall are designed in the same manner as regards the stacking lugs or stacking pockets, it is possible at any time to stack the wound rolls, closed off with the end walls, laterally one next to other and/or one above the other, because the side wall of one end wall can be brought into engagement with the side wall of a further end wall without a preferred alignment of the end walls with respect to one another being necessary. In other words, this means that the stacking lugs and stacking pockets engage or latch in one another in any position of the end walls, be they aligned vertically or horizontally. Care must only be taken that the side wall 30 with the corrugation 31 of the end wall is supported on the pallet 28 or comes into contact with the underside of a pallet which is supported on a finished stack of, for example, four packaged wound rolls.

FIG. 3 shows a perspective bottom view of a second embodiment of the end wall 1 which differs from the end wall according to FIGS. 1 and 2 in that 1) the annular attachment 35 is an integral component of a second attachment 36 which has a rectangular or square shape; and 2) two mutually opposite side walls 30 of the end wall have a corrugation 31 as shown by the broken part of one of the two mutually opposite side walls 30 in dotted lines and the other side wall 30 in full lines.

The outer edges of the second attachment 36 are set back with respect to the edges of the plate 11 by the depth of, for example, approximately 10 mm of the guide grooves 7. Although not shown, the outer edges of the second attachment 36 can also coincide with the edges of the plate 11. At the corners, the second attachment has circular recesses 37 possessing a diameter which is slightly larger than the diameter of the locking lugs 4, so that the second attachment 36 can be pushed or force-fit onto the plate 11 without any problem. The thickness S of the annular attachment 35 is greater than the thickness s of the second attachment 36.

Figure 4:
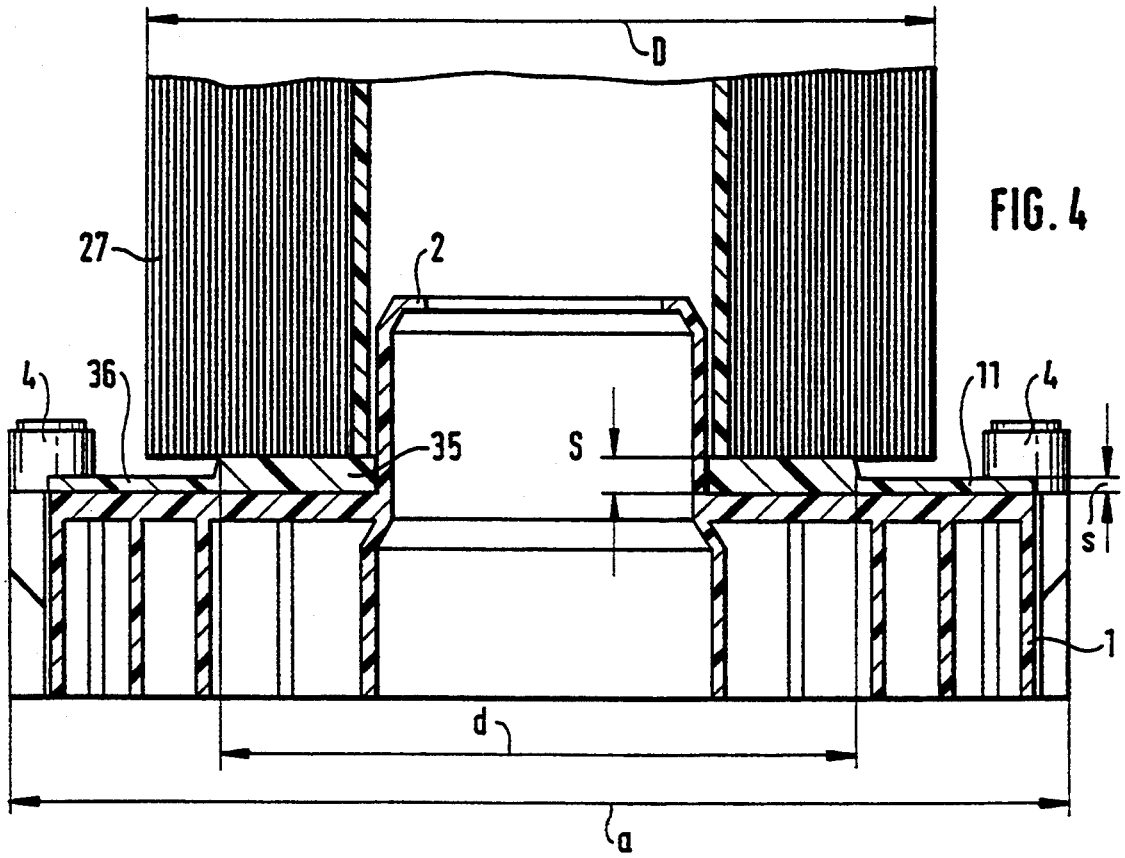
FIG. 4 shows a diagrammatic cut-out of a side view of a wound roll together with an end wall according to FIG. 3.

FIG. 4 shows in sectional view the configuration of the second attachment 36 with the annular attachment 35 and the dimensions of these parts with respect to one another and with respect to the wound roll 27, part of which is shown; and the end wall 1.

Figure 5:
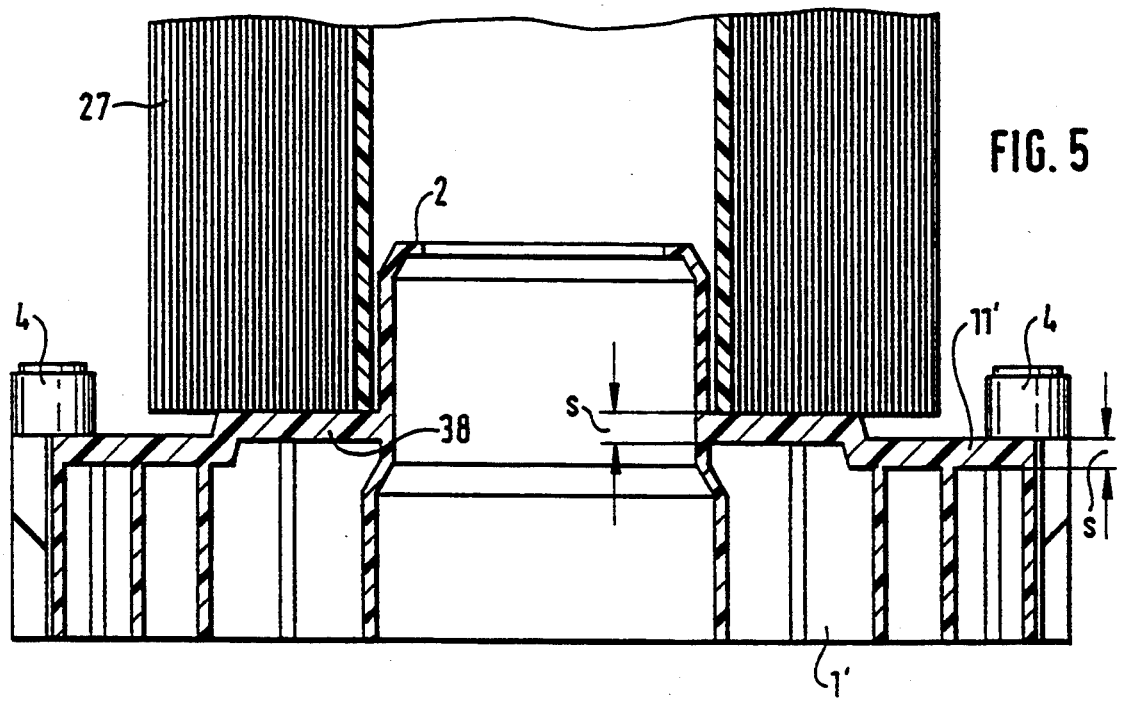
FIG. 5 shows a side view, in section, of a third embodiment of an end wall according to the invention.

In the sectional view, shown in FIG. 5, of a third embodiment of the end wall 1' according to the invention, the annular attachment, as an annular bead 38, is an integral component of the front side of the end wall. The wall thickness s of the plate 11' and of the annular bead 38 are equal, since the plate 11' merges into the annular bead 38. A saving in material is thereby obtained with respect to the embodiment according to FIG. 4. The diameter of the annular bead 38 is smaller than the edge length of the end wall 1'. It is also possible to shape the second attachment 36 and the annular attachment 35 together with the end wall 1 during injection molding, as integral components of the front side of said end wall 1.

Each of the embodiments of the end wall 1,1' whether with a pushed-on (force-fit) annular attachment 35 alone, with a pushed-on (force-fit) second attachment 36 with integrated annular attachment 35 or with an annular bead 38, or with second attachment 36 and annular bead 38, simultaneously injection molded as integral components together with the end wall, provide an annular attachment 35 or an annular bead 38 that ensures that the wound roll 27 projects with its edge region (cf. FIGS. 4 and 5) beyond the annular attachment 35 or annular bead 38. Each of the embodiments thereby avoids the edge region coming into contact with the front side of the end wall 1,1' even if the latter does not bear against the cut edges or the end surface of the wound roll 27 over its full surface, but bears with a slight inclination. In this manner, compressions in the loose edge region of the wound roll are substantially prevented.

While the invention has been shown and described with respect to certain preferred embodiments, it is to be understood that numerous alterations, variations, and modifications of the described embodiments are possible without departing from the spirit and scope of the invention, as described in the appended claims, and equivalents thereof.

What is claimed is:

1. An end wall for a wound roll, comprising:

a rectangular plate having rounded corner surfaces, a front side that faces toward the wound roll and having a central plug-in peg and locking lugs, a reverse side that faces outward away from the wound roll, and side walls;

radial and annular ribs located on said plate for stiffening said plate;

stacking lugs and stacking pockets located on at least one side wall of the plate at right angles to the plate, the stacking lugs delimiting and being shaped in a manner complementary to the stacking pockets;

an annular attachment provided on the front side of the plate and surrounding the plug-in peg; and a second attachment provided on the front side of the plate wherein the annular attachment is an integral component of the second attachment.

2. The end wall of claim 1, wherein the end wall is an injection molded end wall.

3. The end wall of claim 1, wherein the rectangular plate comprises a square plate.

4. The end wall of claim 1, wherein the annular attachment has an external diameter d that is smaller than an edge length a of the end wall and is smaller than a diameter D of the wound roll.

5. The end wall of claim 1, further comprising at least one guide groove located on at least one side wall of the plate.

6. The end wall of claim 5, wherein the second attachment includes outer edges that are set back with respect to edges of the plate by the depth of the guide groove and includes, at corners of the second attachment, circular recesses that have a diameter larger than a diameter of the locking lugs.

7. The end wall of claim 1, wherein a thickness S of the annular attachment is greater than a thickness s of the second attachment.

8. The end wall of claim 1, wherein the annular attachment is pushed onto the plug-in peg.

9. The end wall of claim 1, wherein the second attachment with the integral component of the annular attachment is pushed onto the plug-in peg.

10. The end wall of claim 1, wherein the annular attachment is shaped in the form of an annular bead and is an integral component of said front side of said end wall.

11. The end wall of claim 1 wherein the second attachment and the annular attachment are shaped together with the end wall as integral components of said front side of the end wall.

12. The end wall of claim 1, wherein at least one side wall includes a corrugation that extends over a length of the side wall and at least one guide groove that interrupts the corrugation in the side wall.

13. The end wall of claim 1, further comprising webs for reinforcing the reverse side of the end wall.

14. The end wall of claim 1, wherein two mutually opposite side walls each include a corrugation.

15. The end wall of claim 7, wherein the thickness s is from 2 to 4 millimeters.

16. The end wall of claim 7, wherein the thickness S is from 4 to 20 millimeters.

17. The end wall of claim 1, wherein the central plug-in peg includes V-shaped webs having cross-sections that decrease toward the front side of the plate.

18. The end wall of claim 1, wherein the stacking lugs and stacking pockets each include at least one side surface that is bevelled and inclined toward the side wall.

19. The end wall of claim 12, wherein the corrugation includes prismatic corrugations having triangular cross-sections.

* * * * *